US009083119B2

(12) United States Patent
Reeves

(10) Patent No.: US 9,083,119 B2
(45) Date of Patent: Jul. 14, 2015

(54) CONNECTOR HAVING A HOUSING WITH A PAIR OF ENGAGEMENT ARMS AND CATCH MEMBERS

(71) Applicant: Molex Incorporated, Lisle, IL (US)

(72) Inventor: Jeffrey A Reeves, North Little Rock, AR (US)

(73) Assignee: Molex Incorporated, Lisle, IL (US)

( * ) Notice: Subject to any disclaimer, the term of this patent is extended or adjusted under 35 U.S.C. 154(b) by 49 days.

(21) Appl. No.: 13/803,379

(22) Filed: Mar. 14, 2013

(65) Prior Publication Data

US 2014/0273650 A1 Sep. 18, 2014

(51) Int. Cl.
*H01R 13/627* (2006.01)
*H01R 13/648* (2006.01)
*H01R 13/405* (2006.01)

(52) U.S. Cl.
CPC ..... *H01R 13/648* (2013.01); *H01R 13/6273* (2013.01); *H01R 13/405* (2013.01)

(58) Field of Classification Search
USPC ..... 439/352–358
See application file for complete search history.

(56) References Cited

U.S. PATENT DOCUMENTS 4,718,857 A * 1/1988 Noschese ..... 439/292
4,940,428 A * 7/1990 Heidotting et al. ..... 439/598
5,074,803 A * 12/1991 Chandler et al. ..... 439/347
5,171,161 A * 12/1992 Kachlic ..... 439/352
5,486,117 A * 1/1996 Chang ..... 439/357
5,545,052 A * 8/1996 Hirai ..... 439/354
5,564,939 A * 10/1996 Maitani et al. ..... 439/352
5,569,047 A * 10/1996 Pauza et al. ..... 439/353
5,727,963 A * 3/1998 LeMaster ..... 439/358
5,997,329 A * 12/1999 Kosmala ..... 439/260
6,146,205 A * 11/2000 Lai ..... 439/607.41
6,799,986 B2 * 10/2004 Igarashi et al. ..... 439/358
6,821,151 B2 * 11/2004 Lai ..... 439/607.51
7,387,526 B2 * 6/2008 Liang et al. ..... 439/353
8,777,651 B2 * 7/2014 Miyawaki ..... 439/354
2013/0029516 A1 * 1/2013 Miyawaki ..... 439/352

* cited by examiner

*Primary Examiner* — Chandrika Prasad

(57) ABSTRACT

A connector is disclosed for use in automotive applications, which has improved retention capabilities. The connector includes a body portion that supports an array of conductive terminals. An outer housing is molded over the body portion and the terminal termination area to form an exterior protective housing of the connector. The protective housing of the connector is provided with a pair of engagement arms formed on the exterior of the protective housing. The arms are connected to the housing at their opposite ends and are formed with an intervening space between them and the housing. The space is configured to provide an outward bias force on the engagement arms such that when the connector is inserted into a receiving frame, the engagement arms are biased outwardly to press against sidewalls of the receiving frame and retain the connector in place therein without the need for additional latches or O-rings.

20 Claims, 5 Drawing Sheets

CONNECTOR HAVING A HOUSING WITH A PAIR OF ENGAGEMENT ARMS AND CATCH MEMBERS

BACKGROUND OF THE PRESENT DISCLOSURE

The Present Disclosure relates, generally, to cable interconnection systems, and, more particularly, to improved, rattle-free connectors used in motive environments.

The amount of electronic equipment utilized in automobiles is ever increasing. Automobiles are equipped nowadays with stereo and TV plug and play systems, as well as other telematic equipment such as mobile facsimile machines and computers. The automotive environment provides certain challenges for such telematic equipment. Notwithstanding the suspension system of the vehicle, any automobile is subjected to various shock and dynamic loads during its operation. In order to ensure positive and reliable connections, the electronics industry utilizes O-rings and gaskets with latches to retain a connector in place in a vehicle. In USB-type connectors, these retention features add cost and complexity to the overall connector.

The Present Disclosure is therefore directed to a connector construction, particularly suitable for use in a USB style application, that has improved retention capabilities.

SUMMARY OF THE PRESENT DISCLOSURE

Accordingly, there is provided an improved and economical connector structure that has improved retention capabilities capable of withstanding dynamic and shock loads that normally occur in vehicle operation.

In accordance with an embodiment described in the following Present Disclosure, a connector of the USB-style is adapted to fit into a frame, or bezel plate, that positions the connector in place within a vehicle, such as on a console, dashboard, seatback or the like. The receptacle connector supports a plurality of conductive terminals within it that are capable of high speed data transmission and the terminals may be arranged either on a mating blade or in a receptacle. The terminals may be surrounded by a grounding shield. The terminals have tails, or termination ends, that are terminated to wires of a multiple wire cable and this area is covered by a protective housing.

This protective housing has a body portion that typically encloses the entire termination area and provides a means by which it is attached to the cable. In most applications, the protective housing may be overmolded over both an end of the cable and the terminal support of the connector. The protective housing of the Present Disclosure has at least one, and preferably two, exterior engagement arms that are configured to extend outwardly away from the protective housing. In one embodiment of the Present Disclosure, the arms are formed integrally with the housing and extend outwardly therefrom. The arms are attached, at their opposing ends, to the body of the housing and are spaced away from the housing by an intervening, captured space therebetween. The intervening space that extends between the engagement arm ends is preferably formed with a shape that biases the engagement arms outwardly away from the housing body portion so that the arms will apply an outward force against any opposing surface of a frame into which the connector is inserted. This outward biasing force urges the connector housing rearwardly against angled interior walls of the frame member causing the connector housing catches, or lock members into contact with opposing stop surface.

[In an alternate embodiment, the exterior engagement arms of the connector may be reinforced by a flexible insert that is positioned in the mold prior to overmolding the housing. Ideally, such an insert will be a strip of metal that has elastic properties sufficient to prevent any permanent deformation of the engagement arms due to shock or other dynamic loading. In a third alternate embodiment, the engagement arms may be separately formed, such as form a metal or plastic and attached to the connector housing body in a suitable manner.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 7:
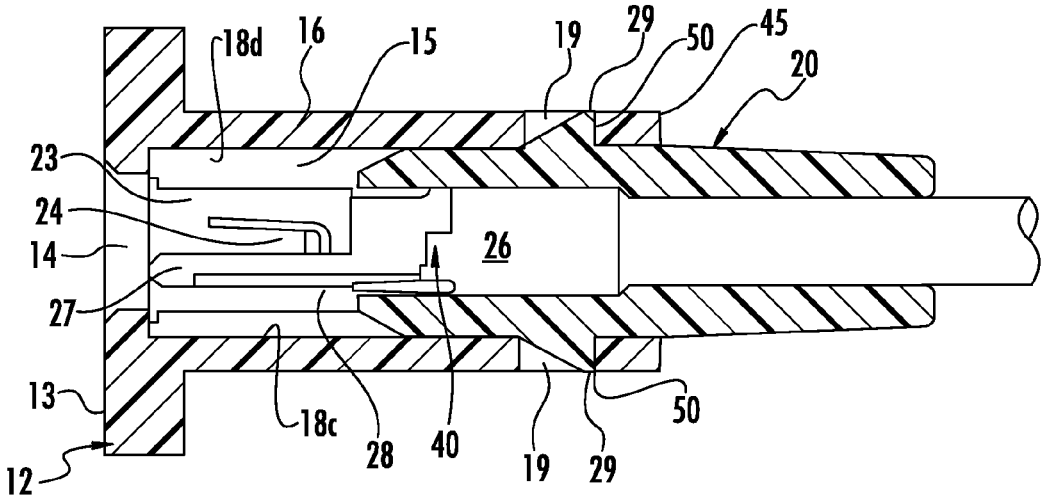
FIG. 7 is a longitudinal sectional view of the assembly of FIG. 2, taken along Line 7-7.

FIGS. 1-4 illustrate a connector assembly 10 that includes a frame member, or bezel plate, 12 for mounting in a vehicle (not shown) and a connector 20 held in the frame member 12. The frame 12 is typically molded out of plastic and includes a faceplate 13 with an opening 14 disposed therein, leading to an interior cavity 15 of the frame member 12. This interior cavity 15 is surrounded by a frame body portion 16 having a continuous configuration which defines a plurality of interior walls 18 arranged as a top wall 18*d*, bottom wall 18*c* and two opposing sidewalls 18*a, b*. Gusset plates 17 may be provided to reinforce the frame member 12 and firmly connect the frame body portion 16 to the faceplate 13. An opening 19 may be formed in the upper part of the frame body portion 16 as illustrated to provide a latching member that engages a corresponding catch 29 formed on the connector 20. Another opening 19 is shown in FIG. 7 and positioned on the other side of the one opening, and disposed in the bottom part of the frame body portion 16.

The connector 20 is illustrated in the Figures as a USB-style connector, one of the types of connectors that are commonly utilized in automotive applications. The USB style connectors are particularly suitable for use in telematic applications, i.e., media and data communication because of their inherent high speed data transmission capability. However, other style connectors can also be utilized with the Present Disclosure with equal results.

It has been found that automotive connectors are subject to shock and dynamic loading during operation of a vehicle due to the vehicle traversing bumps, holes, uneven pavements and the like. During such dynamic loading, the two mating connectors in such a connector assembly may work loose on an intermittent basis, thereby resulting in intermittent data transfer interruption. In other words, if the vehicle passengers are watching a movie in the vehicle or listening to music, they may hear the music cut out or the movie black out while the vehicle traverses a bump or a pothole in the driving surface upon which the vehicle is traveling. Additionally, the dynamic loading can cause the connector to rattle in place within the frame member and this noise is bothersome to the occupants of the vehicle. This problem has been solved in the past by using O-rings as part of a complex connector retention system or multiple external latches that make servicing of the vehicle telematic system difficult.

Figure 1:
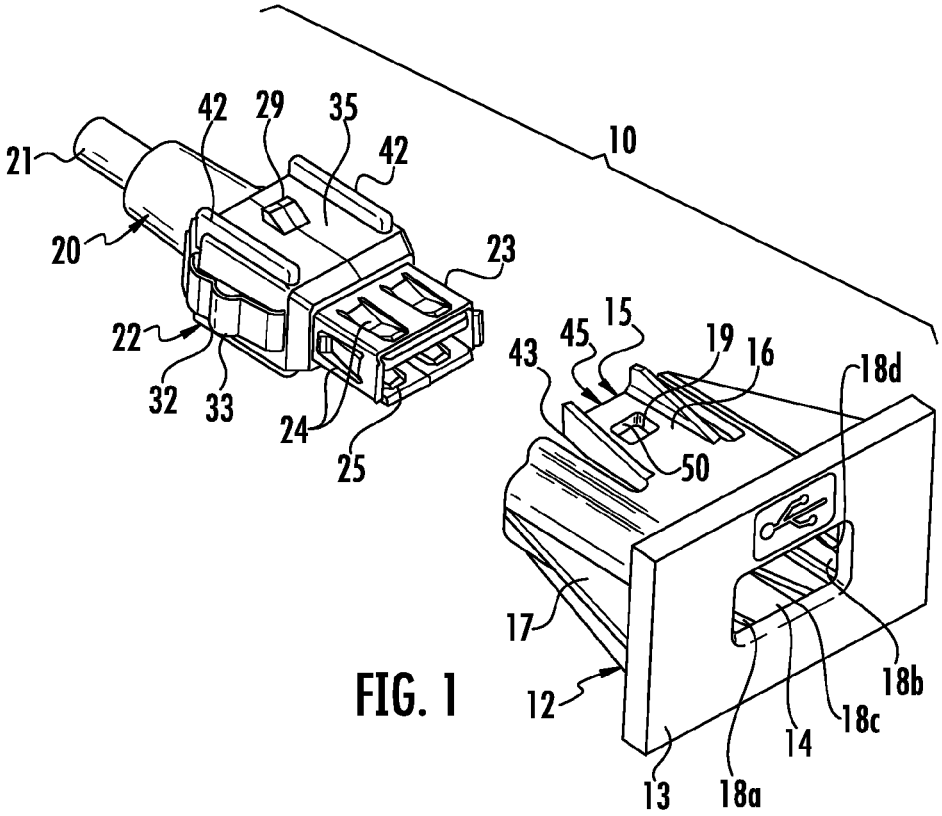
FIG. 1 is a perspective view of a receptacle connector in accordance with the Present Disclosure, and a housing that receives the connector and defines an opening of an opposing, mating connector.
Figure 2:
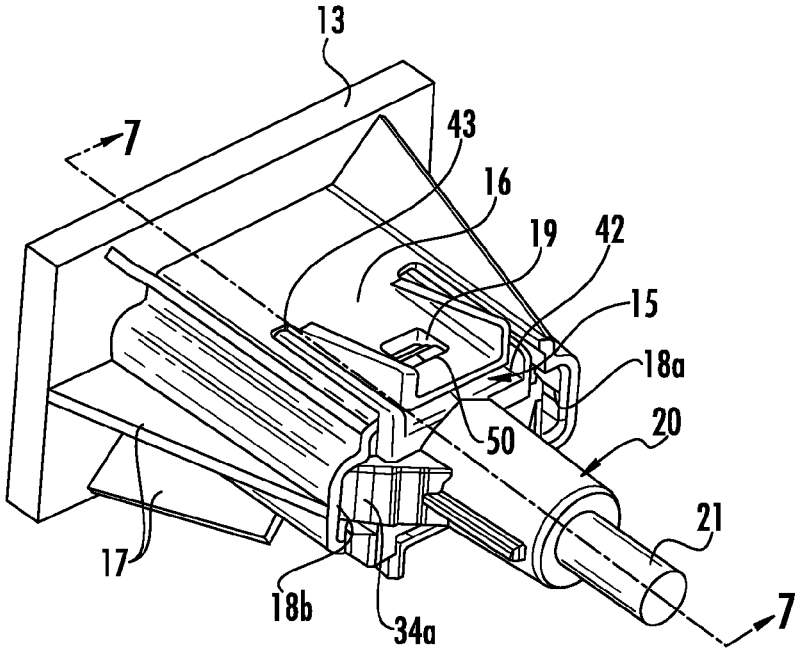
FIG. 2 is a rear view of the connector and housing of FIG. 1, taken from the rear thereof, and illustrating the connector and housing in an assembled condition.
Figure 3:
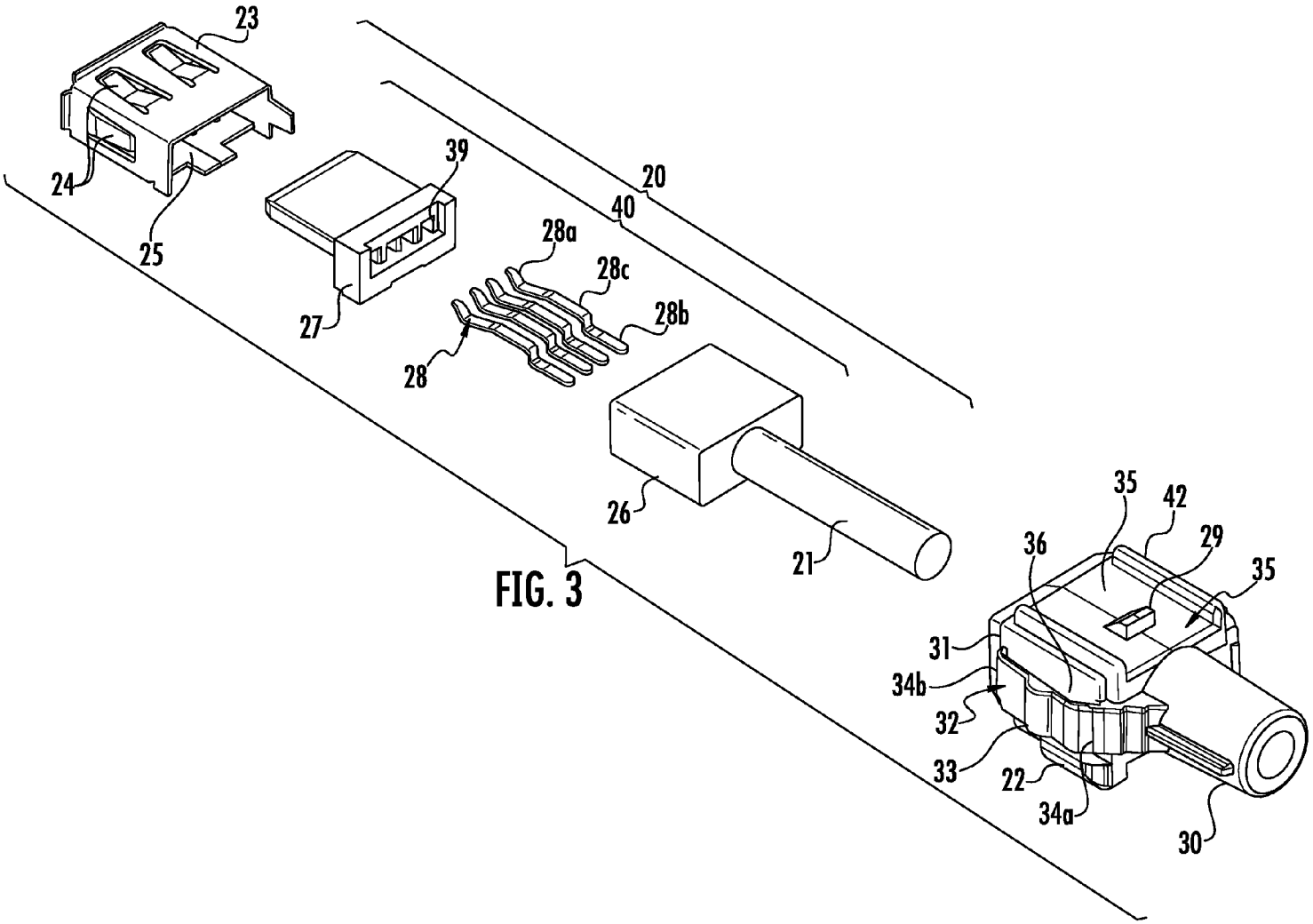
FIG. 3 is an exploded view of the receptacle connector of FIG. 1.

A connector 20 constructed in accordance with the principles of the Present Disclosure is illustrated in FIG. 3, in an exploded format. The connector 20 is of the USB type and as such includes a plurality of conductive terminals 28 arranged in a desired spacing. Each such terminal 28 has a mating portion 28*a* and a tail, or termination portions 28*b* that are interconnected together by an intervening body portion 28*c*. The terminals 28 are supported in part by a mating blade 27 formed of an insulative material, and illustrated as a male mating blade 27 having a plurality of terminal-receiving cavities 39, each of which receives a single terminal 28 therein. The terminals 28 are shown as having a stepped configuration, with the terminal tails, or terminations portions 28*b* being spaced apart from the terminal body portions 28*c*. These tails 28*b* may be terminated directly to individual wires of the cable 21, or they may be terminated to or supported by a circuit board (not shown). In either configuration, the area surrounding the terminal tails hereinafter is referred to as the "termination area," and this area is enclosed by a mass 26 of epoxy, other curable material or a plastic to form a premolded, internal body portion 40 of the connector 20 that includes the mass 26, and portions of the terminals 28 and the mating blade 27.

An exterior shield 23 is preferably provided and may be formed in a conventional manner from sheet metal stamped and formed to define a hollow enclosure, bounded by four walls and having an internal cavity 25. The shield walls may have grounding springs 24 formed therein at desired intervals to provide a means of connection between the connector 20 and an opposing, mating connector (not shown) as well as to provide desired grounding contact around the perimeter of the mating blade 27 so as to provide a measure of EMI ("electromagnetic interference") protection. A protective housing 22 is provided over the internal body portion 40 and parts of the shield 23 and cable 21.

The protective housing 22 is shown as having a catch member, or connector lock member, 29 rising up from an exterior surface thereof and disposed between two upright rail members 42, and the catch member 29 may be positioned so as to engage a latch opening 19 disposed in the frame member 12. The frame member 12 may include a pair of slots 43 that flank the latch opening 19 and which also receive the connector rail members 42. In this manner, a deflectable latching member, or tab, 45 is defined in the frame member 12 which is engaged by the catch member 29 when the connector 20 is fully inserted into the frame member 12 and therefore serves as a means by which to lock the connector 20 in place within the frame member 12. As illustrated in FIG. 7, the frame member 12 has two latch openings 19 disposed therein on opposite sides (top and bottom). Likewise, the connector 20 includes two opposing positioned catch members or connector lock members 29.

The protective housing 22 is preferably molded over the mating blade 27, the terminals 28 housed in the mating blade terminal-receiving cavities 39, a portion of the cable 21 and the mass 26 of that fills in the termination area. This protective housing 22 may include a collar portion 30 that extends away from the rear of the protective housing 22, and which contacts the cable 21 to not only secure the protective housing 22 to the cable 21, but also to provide a strain relief member to the overall connector-cable assembly. The central part of the protective housing 22 may be considered as defining a body portion 35 that encloses the termination area and holds some of the connector components together such as the mating blade 27, inner mass 26 and shield in place with the cable 21. In this regard, the housing body portion 35 may include a front skirt portion 31 that extends around the perimeter of the shield 23.

The protective housing 22 fits inside of the inner cavity 15 of the frame member 12. In order to retain the connector 20 in place within the frame member 12, the protective housing 22 includes a pair of engagement members that take the form of engagement arms 32 that extend lengthwise along the exterior of the protective housing 22. As shown best in FIGS. 1 and 3-4, the arms each include an elongated backbone portion 34 that extends lengthwise and which terminates in two opposing ends 34*a*, 34*b*. Each engagement arm 32 is separated, or spaced apart from the protective housing 22 and particularly, its body portion 35 by way of an intervening opening 36, or spacing. This opening 36 defines an area alongside the protective housing 22 for the associated engagement arm 32 to deflect into during insertion into and removal of the connector 20 from the frame 12.

Figure 4:
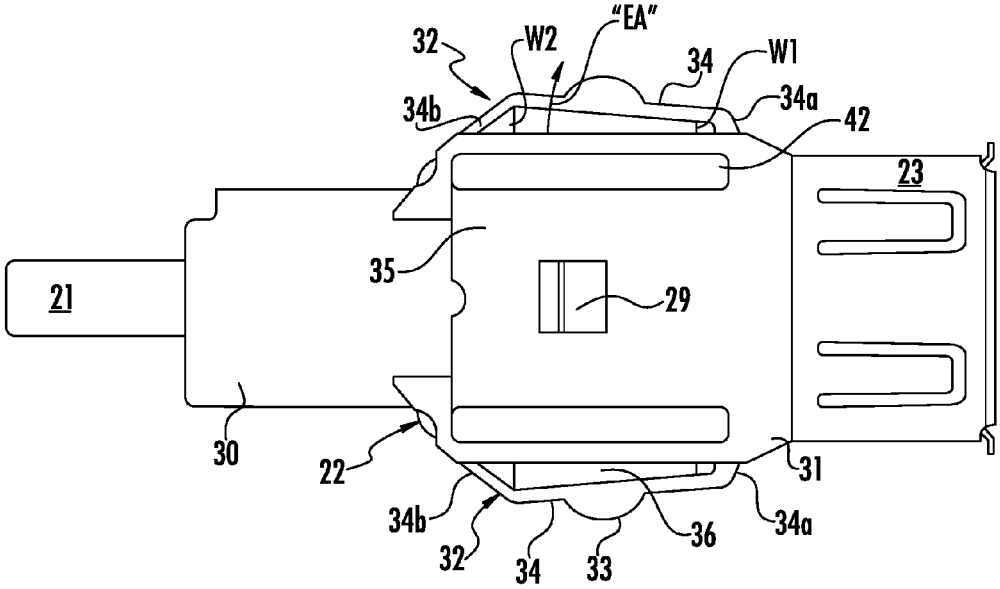
FIG. 4 is a top plan view of the receptacle connector of FIG. 1.

Preferably, the opening 36 is not uniform in its lengthwise extent along the protective housing 22 and as shown in FIG. 4, the opening has different first and second widths, or spacings $W_1$ and $W_2$. The first opposing end 34*a* may be considered as a distal end of its associated engagement arm 32 while the second opposing end 34*b* may be considered as a proximal end of the engagement arm 32. The first width $W_1$ is associated with distal end 34*a*, while the second width $W_2$ is associated with proximal end 34*b*. The second width $W_2$ is preferably greater than the first width $W_1$ as shown in FIG. 4 and thus the proximal end 34*b* of the engagement arm 32 will act as a spring to urge the engagement arm 32 outward, even when the engagement arm 32 is deflected, under load. The spring action of these engagement arms is dependent on their length so the proximal end 34*b* provides its associated engagement arm 32 with a reliable outward bias that urges the engagement arm 32 away from the protective housing 22.

Figure 5A:
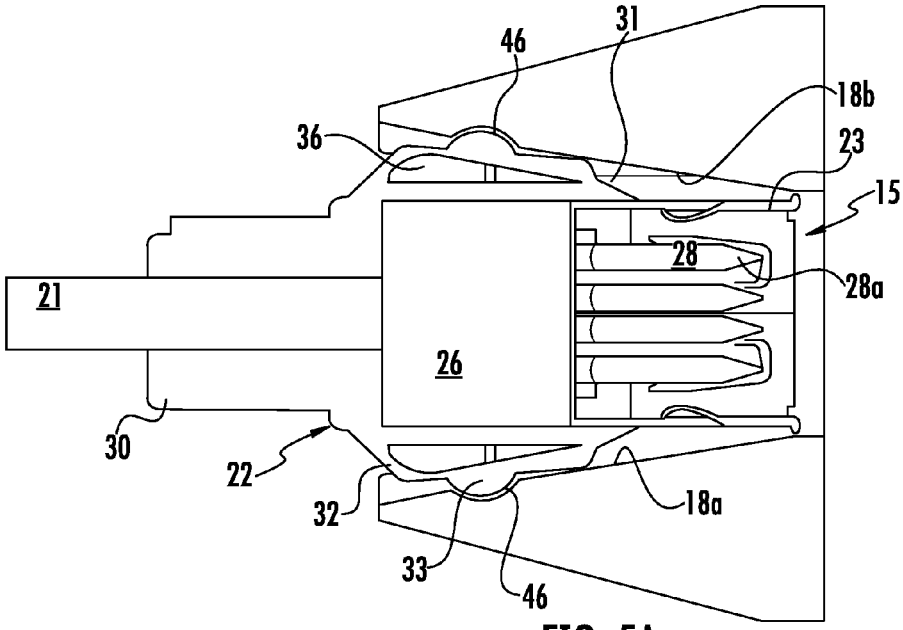
FIG. 5A is a sectional view, taken horizontally through the connector-housing assembly of FIG. 2, illustrating the engagement by the exterior engagement arms of the receptacle connector with complementary recesses in a supporting frame member, or bezel plate.

As noted above, each engagement arm 32 is provided with a protrusion 33 that extends outwardly to provide an engagement member that can reliably engage the interior of the frame connector-receiving cavity 15 and particularly the sidewalls 18*a*, 18*b* thereof. The protrusion 33 is shown as a semi-circular member, but it will be understood that other suitable shapes may be used, such as one with a flat shoulder that may serve as an engagement surface. One manner of this type of connector engagement is illustrated in FIG. 5A where it can be seen that the frame member inner sidewalls 18*a*, 18*b* have been provided with recesses 46 that are complimentary in configuration to the protrusions 33. The greater width $W_2$ of the engagement arm proximal end urges the engagement arm 32 outwardly along the line of action designated by Arrow EA. This outward bias urges the proximal engagement arm to move outwardly away from the protective housing and thereby always exert a positive and reliable force outwardly that maintains pressure against the frame member and particularly the inner sidewalls 18*a*, 18*b* thereof. Thus, the protrusions 33 of the engagement arms 32 are maintained in place in the recesses 46 and in contact with the frame member 12.

Figure 5B:
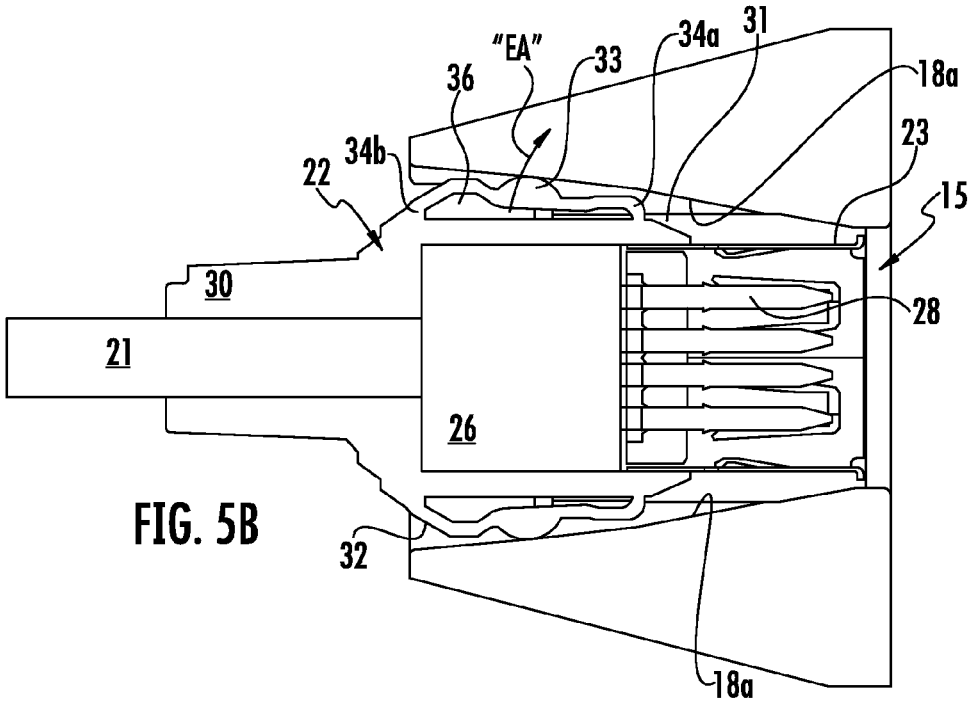
FIG. 5B is a view similar to FIG. 5A, but illustrating the engagement by the receptacle connector exterior engagement arms with an alternate construction of a frame member that utilizes generally flat interior engagement surfaces to form its connector-receiving cavity.

Although recesses 46 may be used, it is preferred that the frame member 12 utilize generally flat surfaces as its inner sidewalls 18*a*, 18*b* so that the structure of the connector 20 maintains a positive outward pressure of the engagement arms 32 on the sidewalls 18*a*, 18*b* of the frame member 12, as illustrated in FIG. 5B, to resist dynamic and shock loads associated with vehicle operation. These inner sidewalls 18*a*, 18*b* are angled outwardly as illustrated so that the outward pressure biases the connector 20 against the flat sidewalls 18*a*, 18*b* to urge the connector rearwardly within the connector-receiving cavity of the frame member 12. This rearward bias moves the connector catch members 29 against the stop surfaces 50 of the frame member openings 19 (FIGS. 1 and 7) and this contact eliminates bothersome rattles and deleterious movement of the connector 20 within the frame member 12. Such a positive pressure dispenses with the need for multiple exterior latches and/or an O-ring retention system, which also permits an easier installation and removal of the connector from the frame member 12. The latch tab 45 of the frame is the only external latching member needed. The protrusions 33 are preferably located forwardly of the catch 29 or along or rearwardly of the location where the terminal tail termination occurs.

Figure 6A:
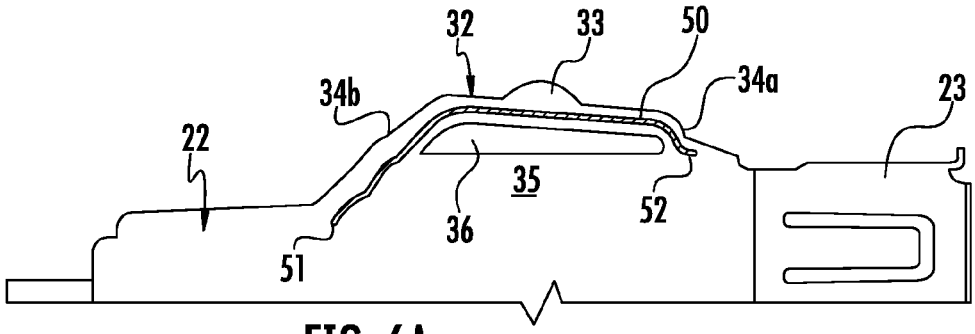
FIG. 6A is an enlarged detail view of one side of a receptacle connector of the Present Disclosure, illustrating an alternate construction of the exterior engagement arm, namely one with an elastic insert.
Figure 6B:
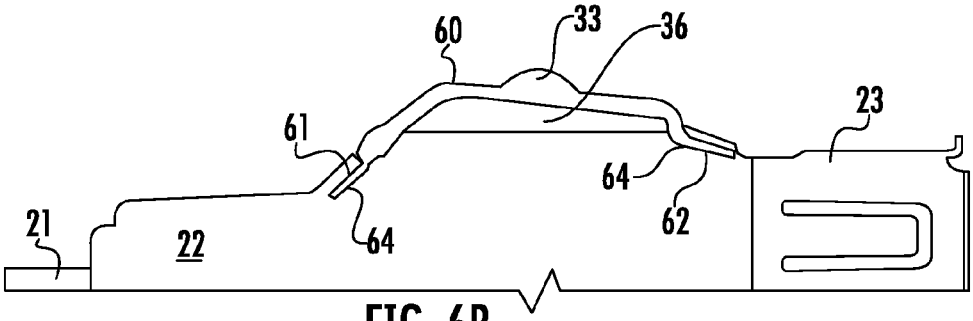
FIG. 6B is an enlarged detail view of the same side of another receptacle connector of the Present Disclosure, illustrating another alternate construction of the exterior engagement arm, one which is formed as a two-piece construction.

FIG. 6A illustrates another embodiment of a connector constructed in accordance with the principles of the Present Disclosure where a flexible insert 50 is provided to reinforce the engagement arm 32. The insert 50 may be formed from either a plastic or preferably sheet metal and it is desired that the insert have elastic properties that permit it to bend during insertion without any permanent deformation. The insert 50 may have its opposite ends 51, 52 extend into the body portion 35 of the protective housing 22 as illustrated or they may end near the junction of the engagement arm ends and the protective housing 22. Still further, in another embodiment, and as illustrated in FIG. 6B the engagement arms may be formed as separate members 60 that have ends 61, 62 which extend into slots 64 of the protective housing 22 and which may be joined together by plastics welding or other suitable means.

While a preferred embodiment of the Present Disclosure is shown and described, it is envisioned that those skilled in the art may devise various modifications without departing from the spirit and scope of the foregoing Description and the appended Claims.

What is claimed is:

1. A connector for insertion into a receiving frame, the connector comprising:

a cable, the cable enclosing a plurality of wires;

a plurality of conductive terminals, the terminals terminated to the cable wires at a termination area, the terminals being supported by, and the termination area being enclosed by, an internal body portion of the connector, the internal body portion including a premolded mass of material; and a protective housing enclosing the termination area, the housing including a pair of engagement arms and at least one catch member, the engagement arms extending lengthwise from parallel sides of the connector, each engagement arm including a backbone portion, each backbone portion terminating in two opposing ends, each backbone portion being spaced from the housing by an intervening opening, the opening having a configuration that biases the backbone portion outwardly from the housing, urging the connector rearward, each catch member extending from a top side of the connector, the top side being perpendicular to the parallel sides;

wherein the engagement arms and each catch member serve to affix the housing within the frame both horizontally and vertically, and centers the housing horizontally within the frame.

2. The connector of claim 1, wherein the frame includes at least a pair of sidewalls, the sidewalls cooperatively defining a connector-receiving passage for receiving the connector therein, the engagement arms engaging the sidewalls when the connector is inserted into the frame.

3. The connector of claim 2, wherein each backbone portion includes a protrusion, and each sidewall includes a recess, each recess receiving a corresponding protrusion when the connector is fully inserted into the frame.

4. The connector of claim 1, wherein each engagement arm includes a protrusion, the protrusion disposed between ends of the engagement arm.

5. The connector of claim 4, wherein the protrusion extends outwardly from each backbone.

6. The connector of claim 1, wherein each opening has a width, the width varying lengthwise along the opening.

7. The connector of claim 1, wherein the ends of each engagement arm comprise a proximal end and a distal end, a body of each engagement arm being spaced apart from the housing by a first spacing and a second spacing, the first spacing being near the distal end, the second spacing being near the proximal end.

8. The connector of claim 7, wherein the second spacing is greater than the first spacing.

9. The connector of claim 1, wherein each engagement arm includes a reinforcement member.

10. The connector of claim 9, wherein the reinforcement member includes a flexible insert, the flexible insert extending within a body of each engagement arm and between the opposing ends.

11. The connector of claim 9, wherein the reinforcement member extends within a body of the engagement arm and into a body of the housing.

12. The connector of claim 1, wherein each engagement arm is formed separately from a body of the housing, the opposing ends thereof being attached to the housing.

13. The connector of claim 4, wherein each protrusion is disposed on the engagement arms at a location rearward of the termination area.

14. The connector of claim 2, wherein each sidewall includes flat surface, the surfaces being angled away from each other, rearwardly within the frame such that when the connector is inserted into the frame, the engagement arms bias the housing rearwardly within the connector-receiving passage against stop surfaces of the receiving frame.

15. A connector-frame assembly, the connector-frame assembly comprising:

a cable, the cable enclosing a plurality of wires;

a connector including a plurality of conductive terminals, the terminals terminated to the cable wires at a termination area, the terminals being supported by, and the termination area being enclosed by, an internal body portion of the connector, the internal body portion including a premolded mass of material, a protective housing enclosing the termination area, the housing including a pair of engagement arms and at least one catch member, the engagement arms extending lengthwise from parallel sides of the connector, each engagement arm including a backbone portion, each backbone portion terminating in two opposing ends, each backbone portion being spaced from the housing by an intervening opening, the opening having a configuration that biases the backbone portion outwardly from the housing, urging the connector rearward, each catch member extending from a top side of the connector, the top side being perpendicular to the parallel sides; and a connector-receiving frame, the connector-receiving frame including at least a pair of sidewalls, the sidewalls cooperatively defining a connector-receiving passage for receiving the connector therein, the engagement arms engaging the sidewalls when the connector is inserted into the connector-receiving frame;

wherein the engagement arms and each catch member serve to affix the housing within the frame both horizontally and vertically, and centers the housing horizontally within the frame.

16. The connector-frame assembly of claim 15, wherein the opposing ends comprise a proximal end and a distal end, a body of each engagement arm being spaced apart from the housing by a first spacing and a second spacing, the first spacing being near the distal end, the second spacing being near the proximal end, the second spacing being greater than the first spacing.

17. The connector-frame assembly of claim 16, wherein each sidewall includes flat surfaces, the surfaces being angled away from each other, rearwardly within the connector-receiving frame such that when the connector is inserted into the connector-receiving frame, the engagement arms bias the protective housing rearwardly within the connector-receiving passage and against stop surfaces of the connector-receiving frame.

18. A connector for insertion into a receiving frame, the connector comprising:

a cable, the cable enclosing a plurality of wires;

a plurality of conductive terminals, the terminals terminated to the cable wires at a termination area, the terminals being supported by, and the termination area being enclosed by, an internal body portion of the connector, the internal body portion including a premolded mass of material; and a protective housing enclosing the termination area, the housing including a pair of engagement arms and at least one catch member, the engagement arms extending lengthwise from parallel sides of the connector, each engagement arm including a backbone portion, each backbone portion terminating in two opposing ends, each backbone portion being spaced from the housing by an intervening opening, the intervening opening having a configuration that biases the backbone portion outwardly from the housing, the opposing ends including a proximal end and a distal end, a body of each engagement arm body being spaced apart from the housing a first spacing and a second spacing, the first spacing being near the engagement arm distal end, the second spacing being near the engagement arm proximal end, the second spacing being greater than the first spacing so as to exert an outward force on the engagement arms, urging the connector rearward, each catch member extending from a top side of the connector, the top side being perpendicular to the parallel sides;

wherein the engagement arms and each catch member serve to affix the housing within the frame both horizontally and vertically, and centers the housing horizontally within the frame.

19. The connector of claim 18, wherein the protrusion extends outwardly from the backbone portion.

20. The connector of claim 18, wherein the protrusions are disposed on the engagement arms at a location rearward of the termination area.

* * * * *